United States Patent [19]

Cremonesi

[11] 3,990,286

[45] Nov. 9, 1976

[54] PIECE WORKING MACHINE FOR THE PRODUCTION OF PUNCHES AND/OR MATRICES

[76] Inventor: Ermete Cremonesi, Via Volta 21, Milan, Italy

[22] Filed: July 7, 1975

[21] Appl. No.: 593,431

[30] Foreign Application Priority Data

July 5, 1974 Italy ..... 24838/74

[52] U.S. Cl. ..... 72/74; 72/450; 76/107 R

[51] Int. Cl.[2] ..... B21J 9/02

[58] Field of Search ..... 72/450, 406, 429, 74; 76/107 R

[56] References Cited

UNITED STATES PATENTS

| | | | |
|---|---|---|---|
| 858,096 | 6/1907 | Murdock | 72/406 |
| 947,760 | 1/1910 | Richards | 76/107 R |
| 2,014,698 | 9/1935 | Reilly | 76/107 R |
| 2,755,689 | 7/1956 | Sundback | 76/107 R |

*Primary Examiner*—C.W. Lanham
*Assistant Examiner*—Gene P. Crosby

[57] ABSTRACT

Piece working machine for the production of such elements as punches, steel types and the like, including a support member for a matrix having a shaped recess and/or a shaped projection for the piece working, and comprising means for causing a relative oscillatory motion between said matrix and piece in the course of working, whereas the piece is pressed against the matrix, the latter being conveniently shaped with a proper contour to afford the desired working.

3 Claims, 6 Drawing Figures

PIECE WORKING MACHINE FOR THE PRODUCTION OF PUNCHES AND/OR MATRICES

This invention relates to a piece working machine, generally steel pieces which upon working completion make up punches or types, both in positive and negative, suitable to various uses, such as, for example, addressing machines or other applications.

The present machine uses a hardened steel matrix carrying out the piece working; said machine can also be used for providing the matrix.

A machine according to the present invention comprises a matrix having a shaped recess and/or a shaped projection for the piece working and is essentially characterized by comprising means for causing a relative oscillatory motion between said matrix and piece in the course of working, whereas the piece is pressed against the matrix, the latter being suitably shaped with a proper contour to afford the desired working.

Thus, a plurality of slight movements of material are provided without the material undergoing any work-hardening, allowing the material to be formed even with very thin edges and completely at cold working condition, as those being required by a printing type.

The matrix can be provided by the same machine, which matrix is formed from a not yet hardened steel piece, the latter being caused to oscillate after placing a sample or specimen type instead of the piece to be stamped.

For a better understanding of these and further features of the machine according to the present invention, an embodiment will now be described of the machine according to the invention, reference being had to the accompanying schematic drawing, in which.

The present machine is particularly used in the manufacture of steel punches (steel types both in positive and negative, particularly for addressing machines and the like).

The machine comprises a fixed frame or casing 1 supporting through straight guides fast with the frame a slide designated as a whole at 2.

Figure 1:
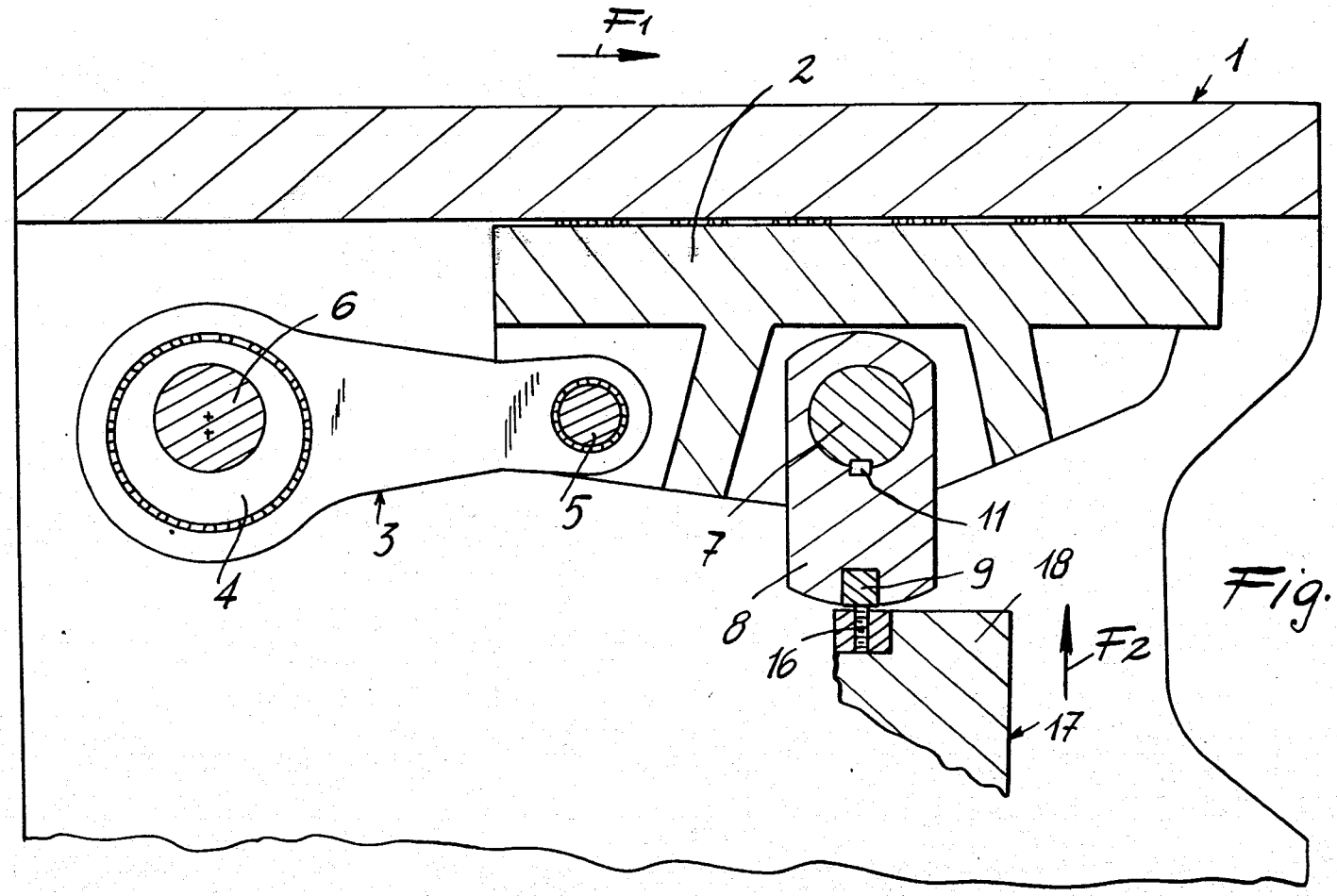
FIG. 1 is a sectional view showing a detail of the machine.

Means are provided comprising a cam system 4 and a connecting rod 3 for the driving of said slide 2 and causing the latter to rectilinearly move in the direction of arrow F1 (shown in FIG. 1) and in the opposite direction. Connecting rod 3 is coupled at 5 to said slide 2 and said driving system is driven through a shaft 6 which is powered and not shown for the sake of simplicity.

Figure 2:
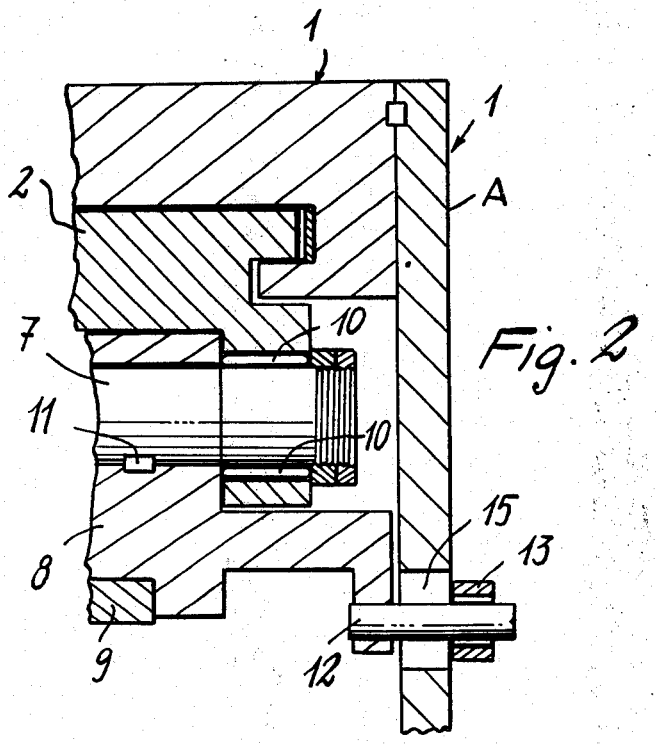
FIG. 2 is a sectional view showing a detail taken along a plane at right angles to that of FIG. 1.
Figure 3:
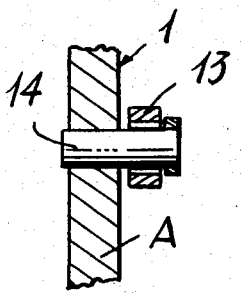
FIG. 3 is a view showing a detail.
Figure 6:
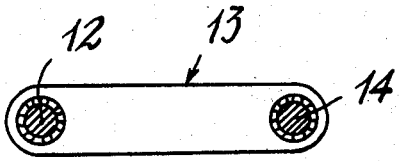
FIG. 6 is a view separately showing a lever.

By means of bearings or cylinders 10 (see FIG. 2) slide 2 carries a pin 7, which is thereby rotable about its own geometrical axis fast with slide 2.

Therefore, when slide 2 is moved in the direction of arrow F1 and in opposite direction, as above described, the geometrical axis of pin 7 will follow said slide 2 in said movements.

Pin 7 has a support 8 secured thereto, for example by means of keys as those shown at 11; in other terms, said support 8 is fast with the pin, or pin 7 and support 8 substantially make up a unitary body.

Support 8 is intended to support a matrix 9 for piece working, that is said matrix 9 is secured to support 8, or becomes fast therewith.

For example, matrix 9 has a shaped impression and by piece working this impression will be provided with a shaped projection corresponding to the shape of said impression, which matrix 9 can also have a shaped projection, thus providing in the piece a correspondingly shaped recess or seat.

Said support 8 is restrained to impart particular oscillations to matrix 9.

More particularly, support 8 has a pin 12 secured thereto (see FIG. 2), which pin 12 is pivoted to a lever 13 at one end of the lever, at the other end said lever 13 being pivoted by a pin 14 to frame or casing 1.

In other terms, lever 13 is substantially a rigid rod pivoted at one end to frame or casing 1 and at the other end to support 8.

Pin 12 is slidable in a wide slot 15 which is provided in a wall A of said frame or casing 1.

It will be appreciated that when slide 2 is rectilinearly oscillating in the direction of arrow F1 and in opposite direction, the geometrical axis of pin 7 follows the slide in said movements and support 8 is oscillated because of being fast with said pin 7 and because of the above described restraint provided by means of said elements 12, 13 and 14. Thus, matrix 9 fast with support 8 is caused to oscillate or swing.

The piece 16 to be worked upon is carried by a system herein referred to as "ram", which unit or "ram" is designated as a whole at 17 in the accompanying drawing. Said unit 17 is operated to upwardly and downwardly vertically move, that is in the direction of arrow F2 (upward movement) and in the opposite direction.

Means are provided for firmly clamping piece 16 to the body 18 of said vertically movable ram 17.

Piece 16 to be worked upon to provide, for example, a punch, is a steel piece in which the engraving of the desired type is to be made, the type being for example a letter of the alphabet.

Piece 16 is inserted between blocks 19,20 and 21,22 in a suitable seat of body 18.

A member 23 is provided for pressing said blocks in order to clamp piece 16. This member 23 is pivoted at 24 to body 18 of ram 17, and a lever 25 is provided and pivoted at 26 to said body 18 of ram 17, the lever 25 acting upon said lever 23.

Provision is also made for a small lever 27 pivoted at 28 to said body 18 and acting through a small pin 29 on said system of blocks clamping said piece 16 to be worked.

The operation of the above described machine is substantially as follows.

Upon energization of the motor driving said shaft 6 through cam-connecting rod system 4,3, slide 2 is operated and rectilinearly oscillates in the direction of arrow F1 and in opposite direction, as above described.

In accordance with the foregoing, support 8 is oscillated and matrix 9 is similarly oscillated.

For example, the matrix is a hardened steel matrix having an engraving which is negative relative to that to be provided in the piece or punch 16, but developed according to an involute corresponding to the movement of the head.

Particularly, the surface of the parts of matrix 9 operating in contact with the metal of piece 16 has a suitable substantially cylindrical bending of a same radius as the radius of rotation for the matrix.

Ram 17 is upwardly moved and thus said piece to be worked is pressed with a considerable pressure against matrix 9 and remains pressed thereagainst in the course of working.

Figure 4:
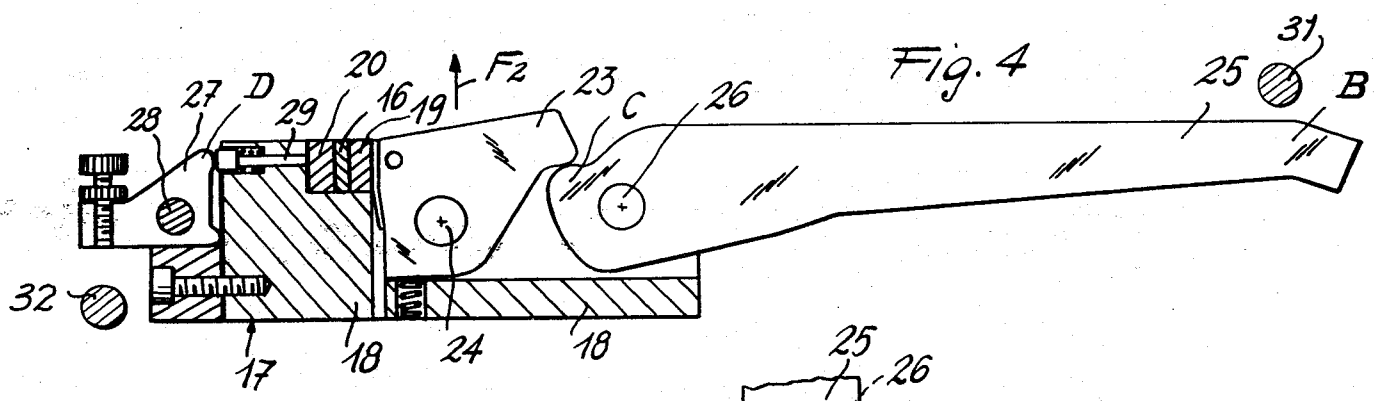
FIG. 4 is an elevational view showing a further detal.
Figure 5:
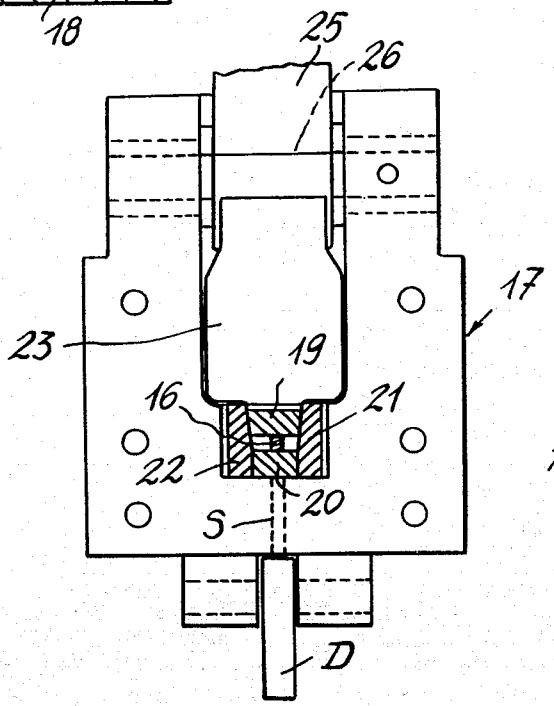
FIG. 5 is a plan view showing the same detail of FIG. 4.

When said ram 17, or body 18 along with the various members carried thereby, is upward moved, or moves in the direction of arrow F2, lever 25 on the side of its arm B (shown in FIG. 4) will somewhere bump against a retainer, 31 that is a member fast with the machine frame or casing.

Therefore, lever 25 is rotated, so that its arm C will act upon lever 23, thus pressing the system of blocks clamping said piece 16, the latter being thereby firmly clamped to support 18. Clamping is conveniently aided by the sloping surfaces of blocks 21 and 22.

Therefore, as piece 16 to be worked is pressed against the swinging matrix 9, said piece 16 is firmly clamped to body 18 of ram 17.

As piece 16 is pressed against matrix 9, the latter moves through a number of complete oscillations.

Thus, should matrix 9 carry a negative type, or a recess corresponding to the desired type, for example a printing type, particularly such as letter A or the like, the same type is formed in positive or relief on piece 16. Matrix 9 could have a positive type, so as to provide a negative type on piece 16, and could also have both relief and recessed elements to provide mixed types having negative and relief parts.

Upon working completion, ram 17 moves down again and, in turn, said small lever 27 bumps against a stop member 32 fast with frame or casing 1, whereby said small lever 27 will operate through small pin 29 to release piece 16, and as apparent lever 23 is by now no longer pressing against said blocks.

From the working standpoint, it is of particular significance the feature according to the present invention, in which a rocking head carrying the matrix is provided.

I claim:

1. A piece working machine for producing such elements as punches, steel types and the like, comprising:

a support member for a matrix having a shaped portion for forming a complementary shape in the piece;

means for causing a relative oscillatory motion between said matrix and piece in the course of working, and for pressing the piece against the matrix, the latter being conveniently shaped with a proper contour to afford the desired working;

a frame;

a slide supported by straight guides fast with said frame;

means for reciprocating said slide along said guides, said support carrying the matrix for said piece, said support being pivoted to said slide so as to oscillate or swing relative thereto, said support being restrained to perform determined oscillations along with the matrix carried thereby as said slide moves, so that said matrix oscillates while remaining in contact with the piece to be worked; and clamp means to support said piece and press with a proper pressure said piece against said matrix.

2. A machine according to claim 1, wherein the matrix support is mounted on a pin journalled in said slide and is restrained at a point adjacent said matrix against reciprocating motion by a small lever which at one end is pivoted to the frame and at the other end is pivoted to said matrix support by means of a second pin passing through a wide slot in a wall of said frame.

3. A machine according to claim 1, wherein means are provided in said support that supports the piece to carry and press the piece to be worked against the rocking matrix, such means providing for clamping and releasing said piece, the clamping means comprising blocks having said piece inserted therebetween, a first lever for pressing said blocks, a second lever which, upon bumping against a fixed element as said support that supports the piece upwardly moves, acts upon said first lever which thereby acts upon said blocks, so as to clamp said piece, the releasing means comprising a small lever which, as said unit downwardly moves, bumps against a fixed element, whereby said small lever rotates and releases the worked piece.

* * * * *